US007097116B2

(12) United States Patent
Fernandez

(10) Patent No.: US 7,097,116 B2
(45) Date of Patent: Aug. 29, 2006

(54) UNDERGROUND SPRINKLER WITH POP-UP HEAD

(75) Inventor: Pablo Rodriguez Fernandez, Burgos (ES)

(73) Assignee: VYR-Valvuleria y Riegos Por Aspersion, S.A., Burgos (ES)

( * ) Notice: Subject to any disclaimer, the term of this patent is extended or adjusted under 35 U.S.C. 154(b) by 0 days.

(21) Appl. No.: 10/716,511

(22) Filed: Nov. 20, 2003

(65) Prior Publication Data

US 2005/0011970 A1 Jan. 20, 2005

(30) Foreign Application Priority Data

Jul. 18, 2003 (ES) ..... 200301704

(51) Int. Cl.
*B05B 15/10* (2006.01)
*B05B 3/00* (2006.01)
*B05B 3/02* (2006.01)
*B05B 3/14* (2006.01)

(52) U.S. Cl. ..... 239/206; 239/203; 239/204; 239/205; 239/230; 239/104

(58) Field of Classification Search ..... 239/203–206, 239/200, 237, 240, 228, 571, 570, 575, 580, 239/104, 230, 231, 201, 251, 255, 233, 232
See application file for complete search history.

(56) References Cited

U.S. PATENT DOCUMENTS

| | | | | | |
|---|---|---|---|---|---|
| 2,928,608 | A * | 3/1960 | Royer | ..... | 239/230 |
| 3,051,396 | A * | 8/1962 | McElhenie | ..... | 239/230 |
| 3,088,677 | A * | 5/1963 | Coffey et al. | ..... | 239/205 |
| 3,625,429 | A * | 12/1971 | Turrell | ..... | 239/206 |
| 4,091,997 | A * | 5/1978 | Ridgway | ..... | 239/206 |
| 4,565,323 | A * | 1/1986 | Berkan | ..... | 239/230 |
| 5,238,188 | A * | 8/1993 | Lerner et al. | ..... | 239/230 |
| 6,478,237 | B1 * | 11/2002 | Kearby et al. | ..... | 239/232 |
| 6,732,950 | B1 * | 5/2004 | Ingham et al. | ..... | 239/205 |
| 6,736,332 | B1 * | 5/2004 | Sesser et al. | ..... | 239/204 |
| 6,814,304 | B1 * | 11/2004 | Onofrio | ..... | 239/201 |
| 6,840,460 | B1 * | 1/2005 | Clark | ..... | 239/205 |

* cited by examiner

*Primary Examiner*—David A. Scherbel
*Assistant Examiner*—Darren Gorman
(74) *Attorney, Agent, or Firm*—Dennison, Schultz & MacDonald

(57) ABSTRACT

An underground sprinkler with a pop-up head and a corresponding underground casing has two differentiated cylindrical parts, closed by a corresponding cover fixed to the pop-up sprinkler head, which, being a part coupled to the piston, pops-up due to the effect of the water pressure pushing the piston in a portion calculated for this purpose and which is so maintained for as long as the pressure lasts, to be recovered by the action of a permanent draw-spring when the pressure stops.

8 Claims, 9 Drawing Sheets

UNDERGROUND SPRINKLER WITH POP-UP HEAD

OBJECT OF THE INVENTION

Coinciding with the title, the object of the invention is a sprinkler, of those which are buried underground and are provided with a pop-up head with the sprinkler means, the spray arc adjustment and control mechanism and the return and swing device for carrying the sprinkler jet to both sides of the position of the head, covering the arc previously established with the adjustment and control mechanism, an arc adjusted so as to water a useful surface, thereby preventing watering of a useless surface.

The object at hand is therefore a sprinkler of those comprised of an underground casing of downwardly decreasing diameters and the interior of which houses the remaining mechanisms; a piston controlled by a coaxial spring ascending due to water pressure; having a filter for preventing the passing of impurities, debris or materials and which, in its ascent, pushes the pop-up head of the sprinkler with all its mechanisms, lifting the cover closing said casing when it is underground.

The pop-up head is therefore provided with a control mechanism incorporated in the neck of the piston of a damping member and a catch device for fixing in place the position of the sprayer, the spray blade and the counterweight arm when the spray arc is not controlled, where different mechanisms intervene for opening or closing the catch, according to whether spraying with a controlled arc or fixed spray is desired or not.

Therefore, the object of the invention is a sprinkler of this type which has been advantageously improved, on one hand, in the water inlet filtering body; in the fixing means for fixing the sprinkler to the underground casing; in the debris disposal conditions and in the manner and means of fixing the spray arc. On the other hand, new fixing means for fixing the two parts of the sprinkler; a jet breaker element, a special shaft for preventing the pop-up head from being released during its spraying duties, and finally, the contribution of a blade without counterweights; a special assembly and reinforcement means along said blade.

BACKGROUND OF THE INVENTION

The background of the invention mainly refer to those existing sprinklers of the American trademark "Rain Bird", of Anthony Manufacturing Corp., which is the owner of currently lapsed patent number U.S. Pat. No. 4,182,494, filed in 1978, corresponding to: "ANTI SIDE SPLASH DRIVE ARM FOR AN IMPACT DRIVE SPRINKLER", constituting the basis for underground sprinklers with a pop-up spray head.

Based on these sprinklers, currently the "MAXI-PAW" models are found, among which the "AG-5" prototype shows a traditional watertight or closed body with downwardly decreasing diameters, and a filtering element joined to the piston shifting with it when it moves up or down.

The piston in question is prismatic and retained by means of a nozzle which screws into the inner wall of the casing and which has a head in the shape of a hexagonal nut, assembled by means of a socket wrench, and several spray head arc controllers, which are composed of corresponding omega-shaped metal strips which pressure fit in said grooves, are assembled in respective circular grooves on the outside of the top end of the piston.

The sprinkler shaft is fixed to the sprinkler head by a corresponding threaded fitting. It is a head which in this case comprises a diffuser blade of a special design, and arms loaded with respective counterweights; an interchangeable spray nozzle of different colors, and the corresponding cover assembled on the head by means of the traditional crampon-anchoring cap.

INVENTIVE STEP

The intention of the invention is to improve the working conditions of sprinklers of this type during operation, as described for the background, such that, by simplifying construction of the apparatus and adjusting the design features and materials of the integrating parts without increasing manufacturing costs, it achieves greater efficacy in the operation thereof, and among others, prevents certain drawbacks of known mechanisms, such as the risk of unsuitable water filtering; not disposing of the debris which can be introduced inside the upper body; not facilitating the dropping down of the debris which may enter. Therefore yhe mechanism improves the way of attaching the piston to the body of the casing; the adoption of fixed adjustment means; a non-detachable assembly of the shaft of the sprinkler head; a simpler structure divided into a lower and a upper body of the sprinkler head and a simpler development of the swing arm without counterweights.

DESCRIPTION OF THE INVENTION

In relation to the inventive step provided in the previous paragraph, a filtering element with a particular design has been provided for which is especially fixed inside of the water feed or supply inlet, such that the impurities which may be dragged remain retained in said filter, since it has a collector effect of the particles when they drop down, retaining them, leading them outside of the piston to the casing, more specifically to the bottom of the latter, such that the filter is dragged in the lifting of the piston when the pressure of the water passing through the filter makes it move upwards, but in a position favoring said retention of particles in order to prevent them from moving upwards to the spray nozzle.

Another detail of the invention, also for the same purpose, is to provide a tubular cylindrical piston having a smooth and cleared outer surface for preventing the adherence or retention of the downward moving particles, such that when it moves up or down it drags said particles or debris, which it will easily drain to the bottom of the casing or lower part of the latter in order to prevent that, when dragging said particles, they may remain retained in the mechanisms of the sprinkler head.

For the same purpose, the invention also provides for the incorporation, in the intersection or irregularity of the upper body of the casing with the lower body thereof, of spaced ports for facilitating the exit of residual water and solid debris, generally soil, which leak through or drop down when the sprinkler is operating, or are dragged when the cover closes the upper body of the casing, and which may affect the elements for rotating and changing the direction of rotation of the sprinkler.

According to the invention, the arc of these changes of rotation is controlled through a corresponding control assembly constituted of omega-shaped elements, a pair of overlapped omega-shaped elements assembled on the upper neck of the piston and made of plastic (for example, DERLIN 500) which, in the inner contour of the circular portion of said parts, have a toothing in a sawtooth form, preferably at a 114° obtuse angle, which rotate in a single direction in the neck of the piston which, for that purpose, has a grooved surface with vertical ribs spaced 60° from one another, having an approximately 30° acute angle profile which, by rotating in a single direction for controlling the rotation arc of the sprinkler head, prevent the arc from varying as a result of the thrust of said movement. It is known that the lower body of the sprinkler has a stop which butts against the branches of the omega-shaped element every time it rotates. If this stop meets no resistance, the omega-shaped element can move, varying the spray arc, taking it out of the prefixed arc which is logically the suitable arc for sprinkler operation.

Another detail of the invention is that the fixing means for fixing the lower and upper sectors of the sprinkler head use two spring rings for each sector shaft, preventing them from becoming jammed due to the soil or sand which may be housed in them.

Likewise, in another detail of the invention, the sprinkler body has a spring-fixed jet breaker screw located in a side position facing the spray nozzle for preventing the position thereof from varying due to the blade tapping against the body, and which, being a screw, can be arranged in a more or less projecting position with regard to the swing blade.

Another feature of the invention is that the shaft supporting the upper part of the body or sprinkler head, where the spring is housed which forces the return of the blade, is a metal shaft with an upper milled end which sticks to the material of the surface of said body, thus preventing said head from being released due to the effect of the rotation.

According to the invention, said sprinkler blade is a blade without counterweights, the ends of which are thickened by prismatic heads made of the same plastic material as the blade, which is specially assembled by means of welding and mechanical fixing and is provided with reinforcement ribs along the entire blade and on both sides of the latter, which perfectly withstand the stresses of the latter, even without counterweights.

A broader idea of the features of the invention will be carried out below in reference to the sheets of drawings attached to this specification which, in a somewhat schematic manner and only serving as an example, show the preferred details of the invention.

IN THE DRAWINGS

PREFERRED EMBODIMENT

Figure 1:
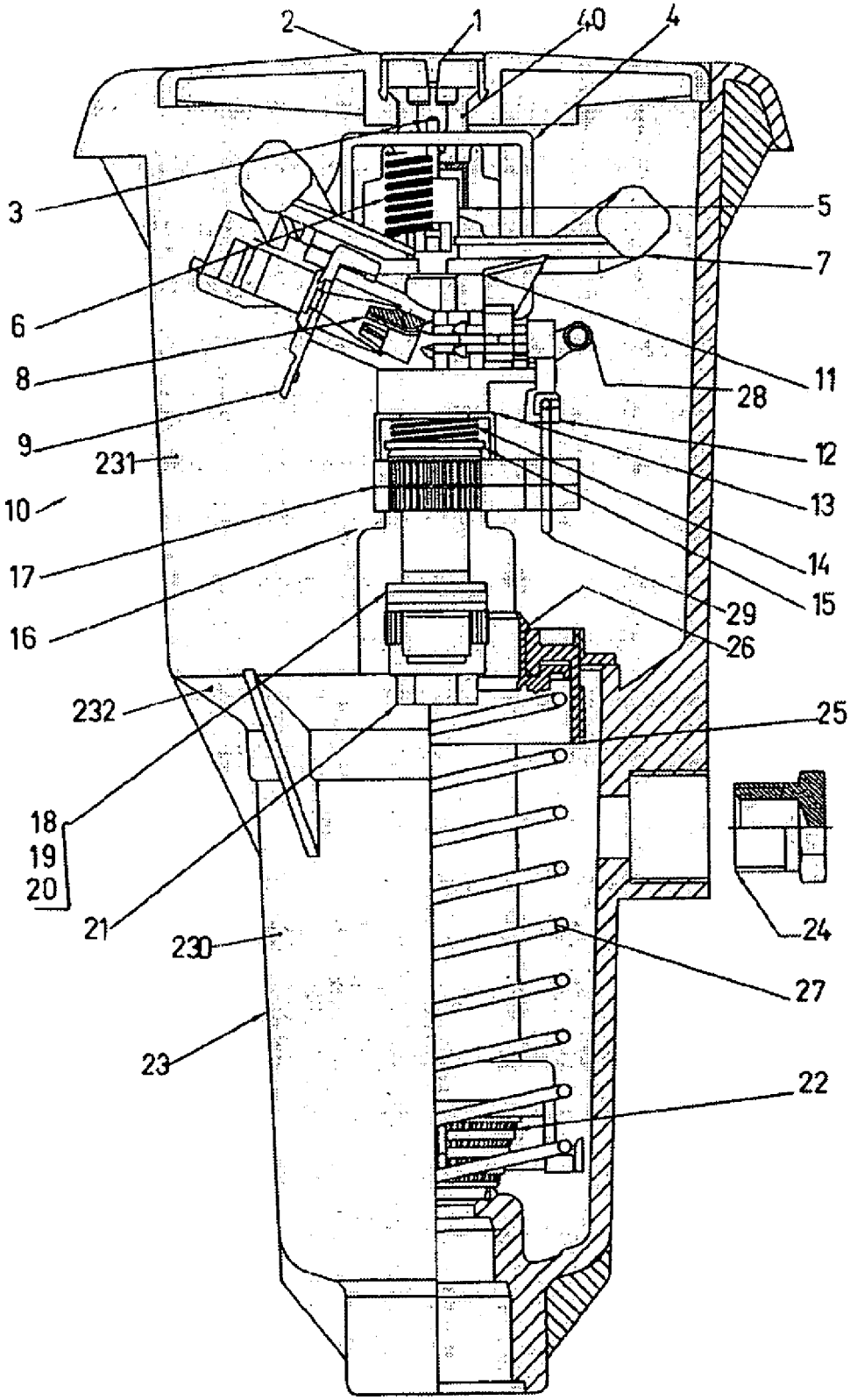
FIG. 1 shows a elevational view symmetrically sectioned according to a vertical plane of the underground sprinkler assembly with a pop-up sprinkler head.
Figure 2:
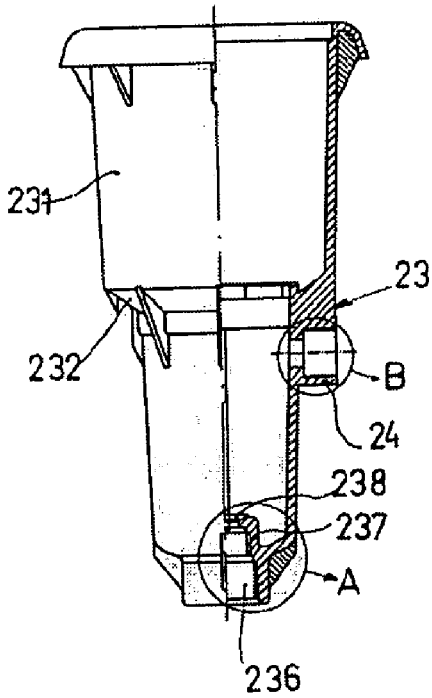
FIG. 2 shows a elevational view symmetrically sectioned according to a vertical plane of the casing.
Figure 4:
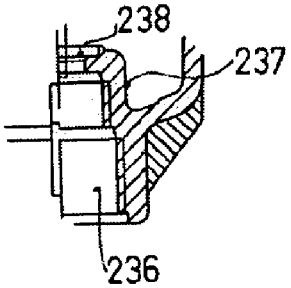
FIG. 4 shows detail A of FIG. 2.

According to said drawings and to that set forth in the description of the invention, a preferred embodiment of the invention is explained below, which is constituted of an underground body or casing (23) which houses all the sprinkler mechanisms and which is hermetically sealed by means of an upper cover (2) due to the effect of the permanent draw-spring (27) when pressure of the supply water, which is what drives the sprinkler assembly, stops. It is a cover (2) suitably joined to the neck (40) of the sprinkler body (4) by means of a claw cap (1).

Figure 3:
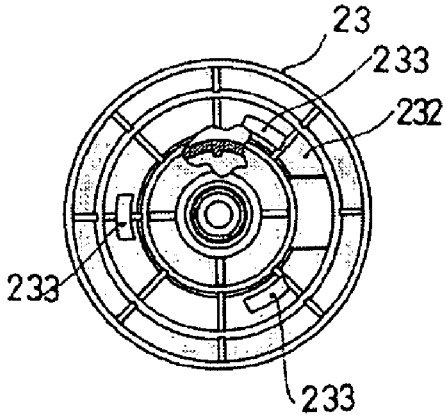
FIG. 3 shows a lower plan view of the casing of the previous figure.
Figure 5:
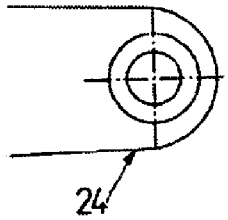
FIG. 5 shows detail B of FIG. 2.
Figure 7:
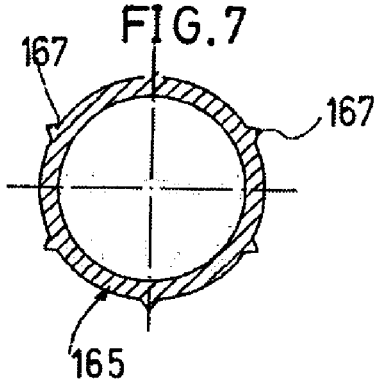
FIG. 7 shows the section along the A-B line of FIG. 6.
Figure 6:
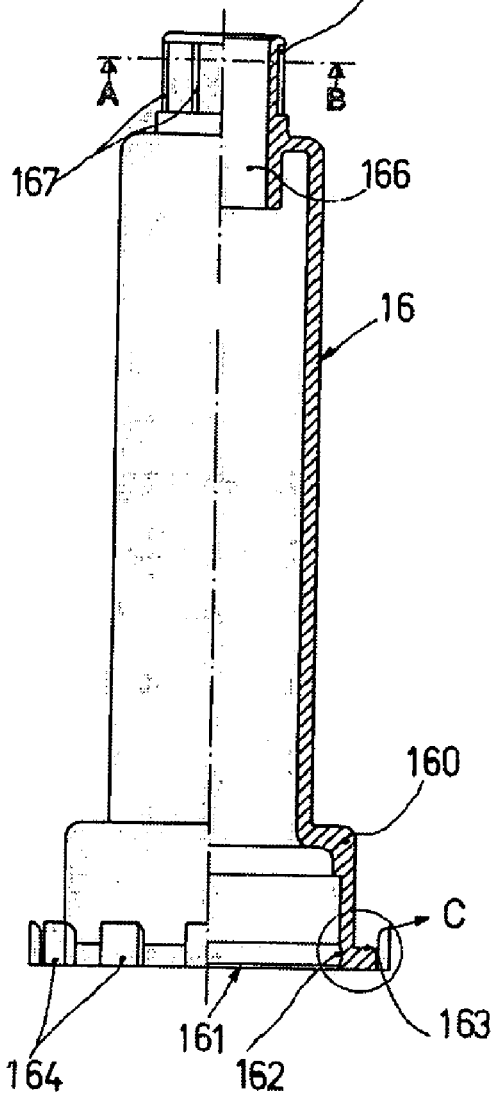
FIG. 6 shows a elevational view symmetrically sectioned according to a vertical plane of the piston.
Figure 8:
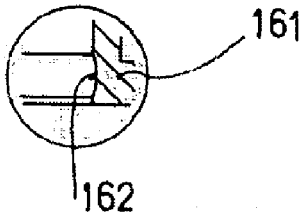
FIG. 8 shows detail C of FIG. 6.
Figure 10:
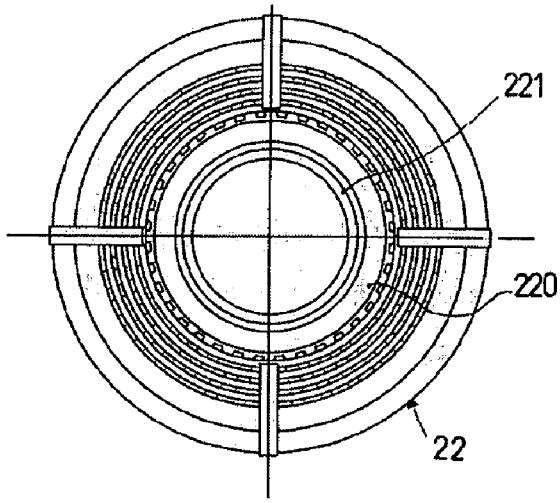
FIG. 10 shows a lower plan view of the filter of FIG. 9.
Figure 9:
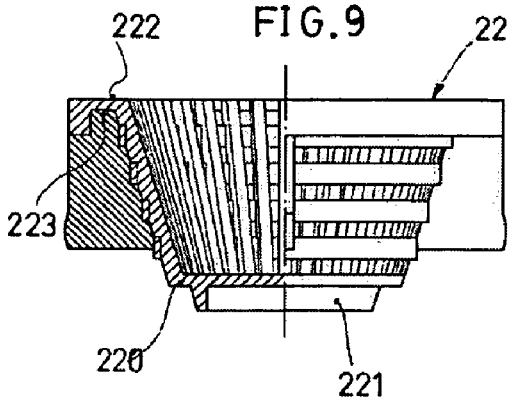
FIG. 9 shows a partially sectioned elevational view of the piston inlet filter.
Figure 11:
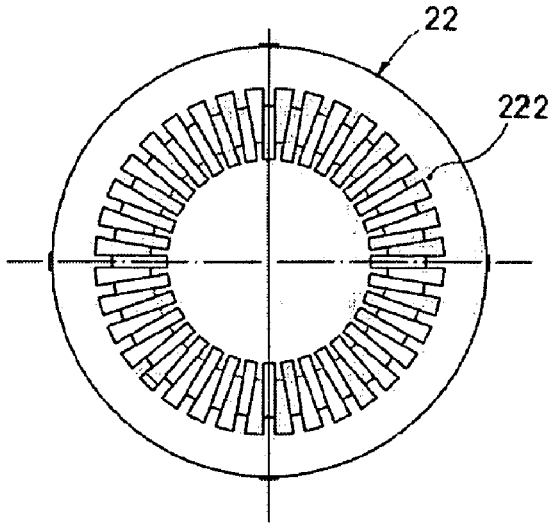
FIG. 11 shows an upper plan view of the filter of FIG. 9.

The body or casing (23) (FIGS. 2 to 5) comprises two parts, a lower cylindrical and tubular part (230) where the piston (16) is housed (FIGS. 6 to 8), and which bears said draw-spring (27) and purifying filter (22) (FIGS. 9 to 11) for the inlet of water, and an upper part (231) where the remaining mechanisms are housed. The upper and lower parts (230 and 231) are connected to one another by a reinforced intermediate beveled part (232), which in areas radially equidistant at 120°, have open ports (233, 234 and 235) (FIG. 3) through which it is possible to pour the debris or particles dragged by the return water outside of the sprinkler when the cover (2) remains open, preventing them from remaining inside of part (231) of the body (23) and preventing them from affecting the sprinkler mechanism (4).

The lower part (230) is provided with a known water inlet (236) which, in this case, internally extends into a penetrating neck (237) provided with an inwardly stepped neck (238) on its inner opening provided for seating and closure of the base of the purifying filter (22). A filter (22) (FIGS. 9 to 11) having a frusto-conical (reverse according to its position) configuration with a closed minor base (220) and a concentric skirting (221) includes a smaller diameter which fits into said neck (238), and a major base (222) with a perimetral flap (223) for being assembled in a suitable opening of the piston (16). The filter (22) closes the inlet (236) wherein is no water passing such that solid particles of a certain size remain on the inside thereof and the debris of a lesser volume drop down to the bottom of the casing (23), outside of the piston (16), such that they cannot return to the inside of the sprinkler (4).

Figure 12:
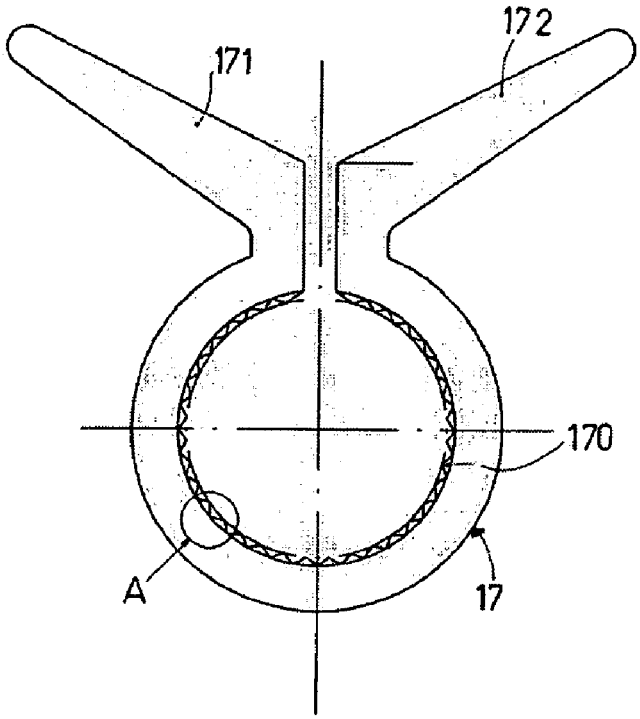
FIG. 12 shows a plan view of one of the omega-shaped control elements.
Figure 13:
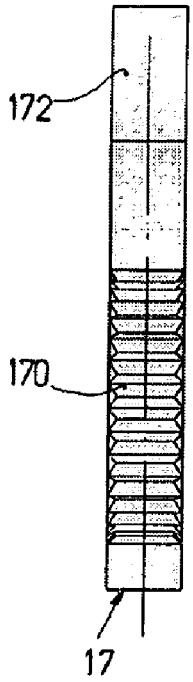
FIG. 13 shows a view along the B–B' line of FIG. 12.
Figure 14:
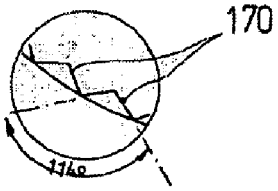
FIG. 14 shows a view of detail—A of FIG. 12.
Figure 16:
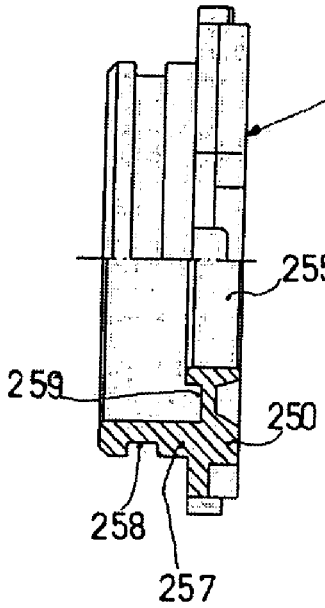
FIG. 16 shows a view partially sectioned along the A—A line of FIG. 15.
Figure 15:
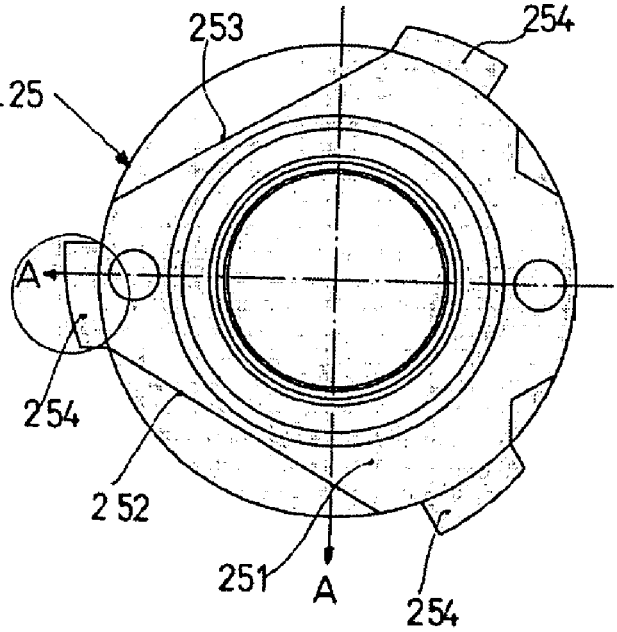
FIG. 15 shows a plan view of the nut at a ¼ turn of assembly of the piston to the casing.
Figure 17:
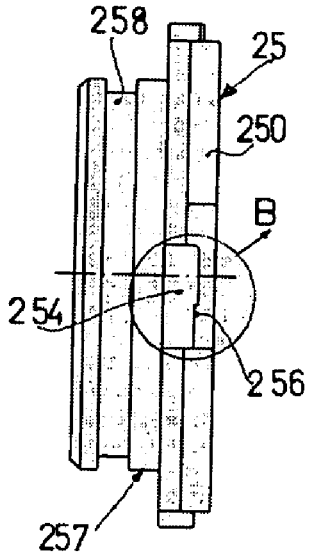
FIG. 17 shows a side elevational view of FIG. 15.
Figure 18:
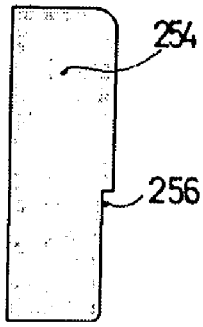
FIG. 18 shows a view of detail—B of FIG. 17.

Said piston (16), which is a tubular and externally smooth cylindrical body (FIGS. 6 to 8), has on the lower end a diametral widening (160), with the internal diameter necessary for receiving the major base (222) of the filter (22), and the opening (161) of said widening portion (160) is provided with an inner concave curve seating (162) for the tight fit of said filter (22), and also has another outer projecting (163), crenellated (164) rim, as a seating of the permanent draw-spring (27). And said piston (16), on the upper end, is provided with a neck (165) having a smaller diameter, with an outer part provided with vertical grooves or ribs (168), with acute triangle profile, provided for the purpose of engaging with the omega-shaped flanges (17) (FIGS. 12 to 14) intended for fixing the spray arc of the sprinkler (4), and another inner part (166) of said neck adapted for receiving a closure plug (21) holding the feed conduit of the sprinkler (4) (FIG. 1) equipped with a sealed gasket constituted of two rubber washers (18 and 20) and another intermediate Teflon washer (19).

At the height of the piston (16) coinciding with the plane of intersection (232) of the body (23), the latter is fixed by means of a quarter turned cover-nut (25) (FIGS. 15 to 18) with the interposition of a leak-tight joint (26) stored in a respective housing (259) through the opening of said nut (25) which has a circular outer plane (250) with a superficial relief (251) with bevels (252 and 253) on two sides for applying a special tool for opening and closing said cover-nut (25) which, in its contour, is provided with projecting teeth (254) equidistant at 120°, of arcuate wedge profile for ensuring the increasing pressure of the closure of said cover-nut (25), and the teeth (254) of which have a slight superficial step (256) for the embedding of said teeth (254) in a respective rib of the intersection (232) of the body (23), not seen in FIG. 1, and which justifies said closure of the cover-nut (25) at a quarter turn.

Figure 19:
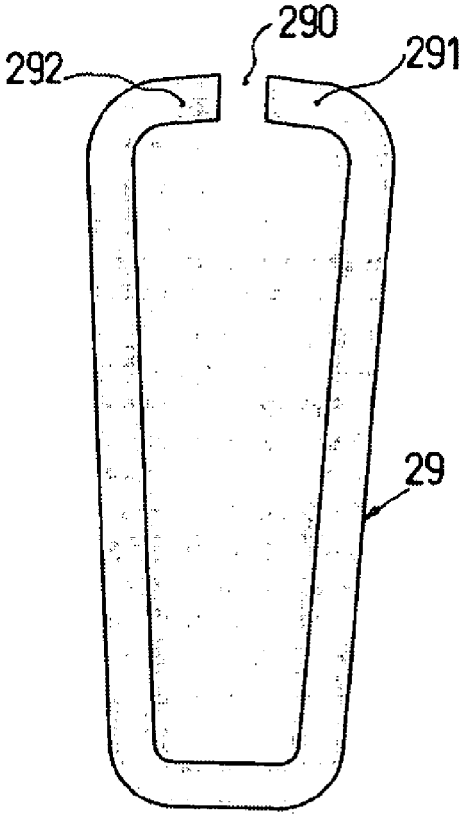
FIG. 19 shows an elevational view of the stop spring.
Figure 30:
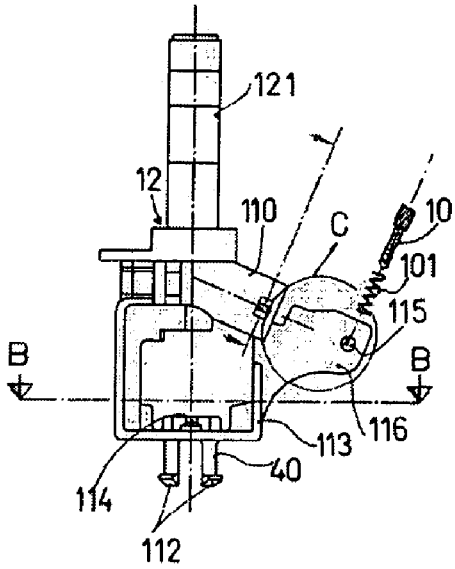
FIG. 30 shows an elevational view of the sprinkler body.
Figure 32:
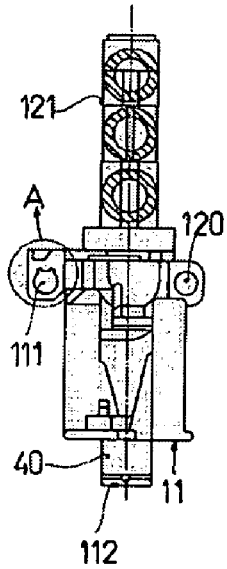
FIG. 32 shows a 90° side elevational view of FIG. 30 from the opposite side, partially sectioned in the shank thereof.
Figure 33:
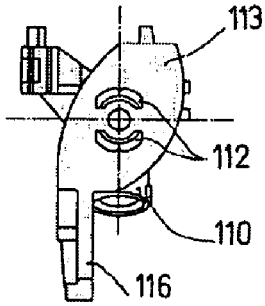
FIG. 33 shows a 90° lower plan view of FIG. 30
Figure 35:
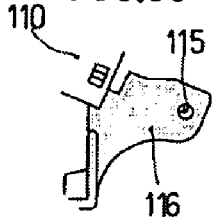
FIG. 35 shows a view of detail—C of FIG. 30.
Figure 36:
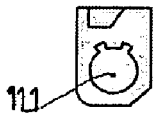
FIG. 36 shows a view of detail—A of FIG. 32.
Figure 34:
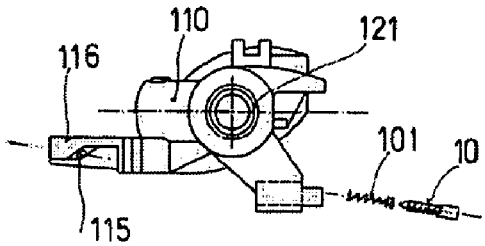
FIG. 34 shows a 90° upper plan view of FIG. 30

Said omega-shaped flanges (17) assembled on the neck (165) of the piston (16) (FIGS. 6 to 8) are provided with an annular body projecting in two divergent branches (171) and (172) for providing it with said omega shape and which, on the inside of the annular body (17), have a toothing (170) with a continuous succession of teeth at 114°, specially designed for engaging in the grooves (167) of the neck (165) which, due to the 60° spacing of the grooves (165) and the acute triangle profile of the latter, permits rotation of the omega-shaped flanges (17) in a single direction or only clockwise, for arranging the spray arc adjusting device of the sprinkler (4) which, for that purpose, is constituted of a set of two overlapping omega-shaped flanges (17) and (173) (FIG. 1) and which branches (171) and (172) constitute the references for limiting the rotation of the lower body (12) of the sprinkler which, in this case, has a stop formed by a spring-square (29) (FIG. 19) which is a stainless steel wire part in the shape of an elongated trapeze, having an opening (290) at the major base, producing two anchors (291) and (292) which are coupled in the lower sector (12) of the sprinkler head (FIGS. 30 to 36), more specifically in a side housing (120) of said lower sector (12) which, together with the upper sector (11), integrate the sprinkler body (4) which, in this case, is provided with an adjustable jet breaker screw (10) housed, with the interposition of a damping spring (101), in a biased housing (115) contained on a side extension (116) of the head (113) of said upper sector (11) (FIGS. 30 and 34), and is oriented laterally to the spray conduit (110) provided with its corresponding nozzle (9) and filter (8), such that the screw (10) breaks the spray jet as it crosses with it, since it can project more or less, making the jet to be spread more or less according to the impact.

Figure 20:
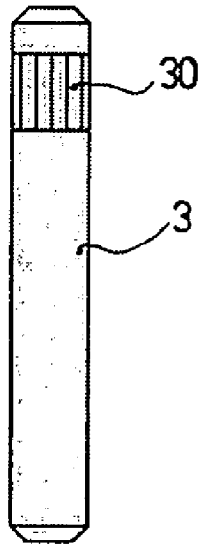
FIG. 20 shows an elevational view of the milled shaft.
Figure 22:
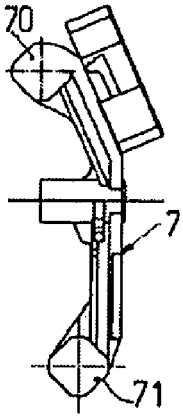
FIG. 22 shows a 90° side elevational view of FIG. 21.
Figure 21:
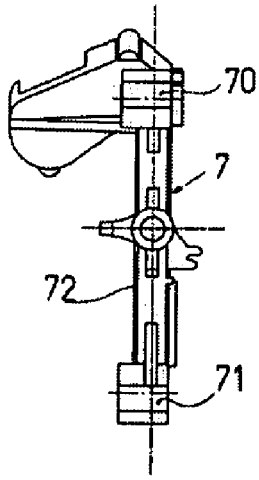
FIG. 21 shows a plan view by the lower plane of the sprinkler blade.
Figure 23:
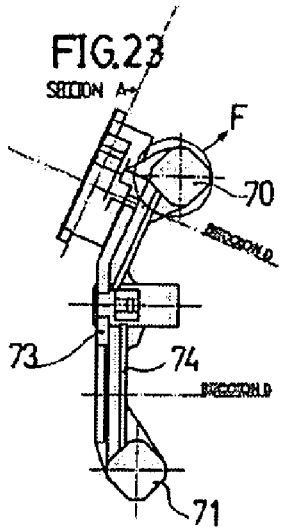
FIG. 23 shows a 90° side elevational view of FIG. 21 from the opposite side.
Figure 25A:
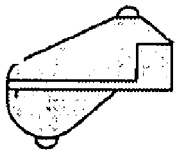
FIG. 25A shows a view of—G cut of FIG. 25.
Figure 25:
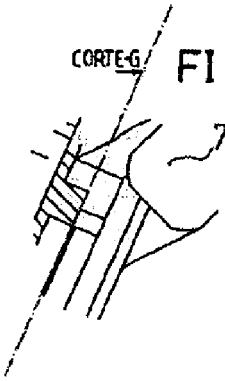
FIG. 25 shows a view of detail—F of FIG. 23.
Figure 24:
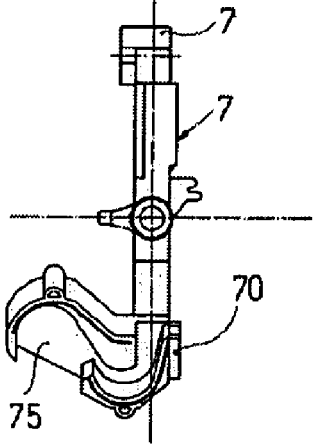
FIG. 24 shows a 90° upper plan view of FIG. 21.
Figure 27:
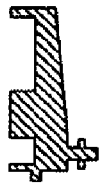
FIG. 27 shows a view of section—D of FIG. 23.
Figure 26:
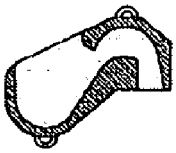
FIG. 26 shows a view of section—A of FIG. 23.
Figure 29:
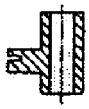
FIG. 29 shows a view of section—C of FIG. 23.

The lower sector (12) is also integrated by the feed conduit (121) of the spray conduit through which the spray conduit (110) (FIGS. 30 to 32) is fed and from which the shaft (3) for holding the lower (12) and upper (11) sector of the sprinkler body (4) projects; a stainless steel shaft (3) having a milled end (30) (FIG. 20) rigidly fixed to the head (113) of the upper sector (11) in a corresponding enclosure (114) for preventing the spray body (4) from becoming loose due to the effect of the regular movement of the sprinkler when in spraying operation. The enclosure (114) is located in the center of the neck (40) between the claws (112) acting as an anchor to the cap (1) which holds the cover (2) closing the body (231) of the casing (23).

Figure 28:
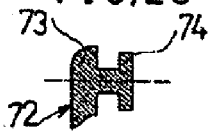
FIG. 28 shows a view of section—B of FIG. 23.
Figure 31:
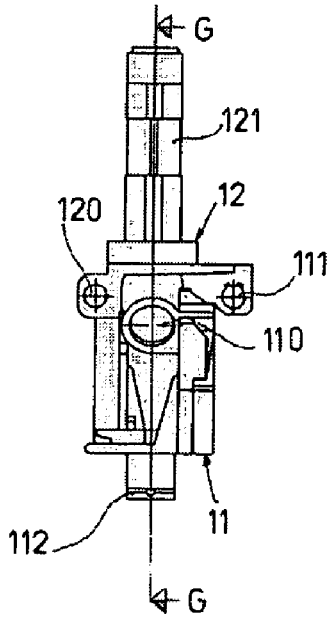
FIG. 31 shows a 90° side elevational view of FIG. 30.

The swing diffuser blade (7) is assembled on the stainless steel shaft (3) itself, on the upper sector (11) of the sprinkler body (4), which blade is pressed on by the corresponding torsion spring (6) of the sprinkler body (4), with the inclusion of a respective plate (5) of the stainless steel shaft (3). According to the invention, a diffuser swing blade (7) (FIGS. 21 to 24) constituted of a single plastic (DERLIN 500) part having respective irregular prismatic rolls (70–71) acting as counterweights without having any dead weight whatsoever and located on the ends of an arm (72) in the shape of a wide open yoke, which is an arm reinforced by longitudinal ribs (73) and (74) (FIG. 28) giving the diffuser swing blade (7) a strong consistency, which blade, on one end, has the corresponding diffuser sprayer (75) having a known "S" shape. Finally, the swing device of said blade (7) is completed with spring (28) (FIG. 1) of the catch which fixes or releases the swinging of said blade (7), and, in an axial position, under the lower sector (12), an anti-sand plate (13), the compensating damping spring (14) and the spring washer (15) (FIG. 1) are arranged. It is also provided with the corresponding side safety plug (25) (FIG. 1).

Having suitably described the nature of the invention, it is stated for the record that the invention is not limited to the exact details of this description, but rather on the contrary, those modifications deemed suitable will be introduced, as long as they do not alter the essential features thereof, which are claimed below.

The invention claimed is:

1. A rotating underground sprinkler with a pop-up head, consisting of a corresponding underground casing, comprising an upper cylindrical part having a first diameter and a lower cylindrical part having a second diameter, a cover on a top portion of said upper cylindrical part and fixed to the pop-up sprinkler head operably coupled to a piston, said piston is operable as a result of water pressure and displaced proportionally to the water pressure against the resilience force of a permanent draw-spring, comprising:

a draining and cleaning means disposed in an intersection of said upper cylindrical part (230) and said lower cylindrical part (231) for preventing the jamming of the sprinkler; and wherein the draining and cleaning means are openings (233, 234 and 235) provided on a beveled surface of the intersection of the upper cylindrical part and the lower cylindrical part and radially arranged relative to one another at 120°;

a cover-nut (25) disposed within said casing at said intersection of said upper cylindrical part and said lower cylindrical part for securing the piston therethrough, said piston having a smooth tubular cylindrical body; wherein the cover-nut includes a cylindrical body (250) with a circular plan provided with a superficial rib (251) with bevels (252, 253) on two sides, and further comprising projecting arcuate wedge-shaped teeth (254) on a peripheral edge and each positioned relative to one another at 120°, and further comprising a central passage (255) for the piston (16), and a circumscribed circular housing (259) on the inside part of the cover nut for storing a leaktight joint part (26) having a profile suitable for fitting to said piston (16), and a doughnut-shaped housing (258) on the outside part of the cover nut for a joint for fitting to the lower cylindrical part (230);

an inlet filter (22) disposed on a lower end and within said lower cylindrical part;

a pair of omega-shaped elements (17) for arranging and adjusting the spray arc of the sprinkler each operably attached to a neck (165) of the piston (16) and includes an annular body with a pair of divergent branches (171), (172), wherein said sprinkler further comprises a lower sector and an upper sector, and a jet stream outlet on said upper sector;

a stop (29) made of stainless steel wire having an elongate body and is coupled to said lower sector (12) of the sprinkler, said stop configured to engage said pair of divergent branches of said pair of omega-shaped elements;

a non-detachable stainless steel shaft (3) for assembling together the lower (12) sector and said upper (11) sector of the sprinkler;

an adjustable jet breaker apparatus comprising a jet breaker screw operably attached to said upper sector (11); and, said jet breaker apparatus further comprising a single-piece, plastic, reinforced diffuser blade (7) operably attached on said stainless steel shaft without counterweights for breaking the jet stream.

2. An underground sprinkler with a pop-up head according to claim 1, wherein the piston further comprises a widened part (160) with a concave curve seating (162) for adapting a base (222) of the purifying filter (22) and a smaller diameter neck (165) on an upper end thereof provided with several external vertical ribs (167) for engaging a plurality of teeth on the annular body of the omega-shaped elements and thereby controlling the spray arc.

3. An underground sprinkler with a pop-up head according to claim 2, wherein the vertical ribs are equidistantly spaced at 60°.

4. An underground sprinkler with a pop-up head according to claim 2, wherein the purifying filter for the water inlet further comprises a frusto-conical body (22), having a closed minor base (220) and another upper, open major base (222) with an annular flange, wherein said purifying filter is pressure fitted in a lower part (162) of the piston (16).

5. An underground sprinkler with a pop-up head according to claim 4, wherein the minor base of the filter further comprises a concentric outer rim (221) which is housed and closed in an inner stepped (238) neck (237) of an inlet (236) of the lower cylindrical part.

6. An underground sprinkler with a pop-up head according to claim 3, wherein the plurality of teeth for the pair of omega-shaped elements are on an inner surface of the annular body, each tooth having a triangular configuration having a first engaging side and a second engaging side positioned at 114° with respect to the first engaging side, wherein the pair of omega-shaped elements rotate in a single direction in said ribs (167) of the upper neck (165) of the piston (16).

7. An underground sprinkler with a pop-up head according to claim 6, wherein said stainless steel wire is in the form of an elongated trapezium having a central opening (290) on a bottom portion thereof, thereby producing two anchors (291–292) which are fixed in a corresponding housing (120) of the lower sector (12) of the sprinkler.

8. An underground sprinkler with a pop-up head according to claim 1, wherein the stainless steel shaft for assembling the sprinkler further comprises a milled space (30) where a head (113) of the sprinkler is non-detachably fixed.

* * * * *